US006786269B2

(12) United States Patent
Senesac et al.

(10) Patent No.: US 6,786,269 B2
(45) Date of Patent: Sep. 7, 2004

(54) REMOVABLE DECORATIVE VANE COVER

(75) Inventors: Wayne M. Senesac, Oxford, IN (US); Polet Senesac, Oxford, IN (US)

(73) Assignee: Oxford House, Incorporated, Oxford, IN (US)

( * ) Notice: Subject to any disclaimer, the term of this patent is extended or adjusted under 35 U.S.C. 154(b) by 153 days.

(21) Appl. No.: 10/103,483

(22) Filed: Mar. 22, 2002

(65) Prior Publication Data

US 2003/0178153 A1 Sep. 25, 2003

(51) Int. Cl.[7] ..... E06B 3/32
(52) U.S. Cl. ..... 160/89; 160/84.01; 160/168.1 V
(58) Field of Search ..... 160/89, 236, 166.1 R, 160/84.01, 168.1 V, 900, 84.04, 348

(56) References Cited

U.S. PATENT DOCUMENTS

| | | | | |
|---|---|---|---|---|
| 2,874,772 A | | 2/1959 | Dwyer et al. | |
| 3,106,240 A | | 10/1963 | Weber | |
| 3,844,330 A | | 10/1974 | Hyman | |
| 3,851,699 A | | 12/1974 | Shapiro | |
| 4,049,038 A | | 9/1977 | Hyman et al. | |
| 4,049,038 A | | 9/1989 | Hyman et al. | |
| 4,911,220 A | | 3/1990 | Hiller | |
| 5,012,552 A | | 5/1991 | Wulf | |
| 5,249,617 A | | 10/1993 | Dürig | |
| 5,297,607 A | * | 3/1994 | Beauchamp | 160/84.05 |
| 5,392,833 A | | 2/1995 | Ohanesian | |
| 5,439,042 A | | 8/1995 | Ohanesian | |
| 5,490,553 A | | 2/1996 | Colson et al. | |
| 5,603,369 A | | 2/1997 | Colson et al. | |
| 5,626,177 A | | 5/1997 | Colson et al. | |
| 5,638,880 A | | 6/1997 | Colson et al. | |
| 5,638,881 A | | 6/1997 | Ruggles et al. | |
| 5,713,407 A | | 2/1998 | Judkins | |
| 5,715,883 A | | 2/1998 | Keith | |
| 5,749,404 A | | 5/1998 | Colson | |
| D397,571 S | | 9/1998 | Anthony et al. | |
| 5,819,833 A | | 10/1998 | Swiszcz et al. | |
| 5,845,690 A | | 12/1998 | Colson et al. | |
| 5,876,545 A | | 3/1999 | Swiszcz et al. | |
| 6,164,363 A | | 12/2000 | Colson et al. | |
| 6,170,548 B1 | | 1/2001 | Swiszcz et al. | |
| 6,186,213 B1 | | 2/2001 | Senesac | |
| D444,698 S | | 7/2001 | Anderson | |
| 6,334,477 B1 | * | 1/2002 | Moir | 160/89 X |
| 6,510,885 B1 | * | 1/2003 | Shih | 160/89 |

FOREIGN PATENT DOCUMENTS

| | | |
|---|---|---|
| WO | WO 96/35855 | 11/1996 |

OTHER PUBLICATIONS

Hunter Douglas Window Fashions, product literature.

* cited by examiner

*Primary Examiner*—David Purol
(74) *Attorney, Agent, or Firm*—Woodard Emhardt Moriarty McNett & Henry LLP

(57) ABSTRACT

A blind system includes a first blind vane having an edge portion and a second blind vane having an edge portion. The system includes a cover that forms a u-shaped fold that extends between the first vane and the second vane. A first reattachable fastener detachably couples the cover to the first vane at the edge portion of the first vane. The first fastener is constructed and arranged to allow the cover to be detached and reattached to the first vane. A second reattachable fastener detachably couples the cover to the second vane at the edge portion of the second vane. The second fastener is constructed and arranged to allow the cover to be detached and reattached to the second vane.

36 Claims, 5 Drawing Sheets

REMOVABLE DECORATIVE VANE COVER

BACKGROUND OF THE INVENTION

The present invention generally relates to blind systems, and more specifically, but not exclusively, concerns a blind cover that is detachably coupled to a plurality of vanes so that the vane cover can be removed when needed.

A common covering system for windows, sliding glass doors and other types of openings are vertical blinds. The vertical blinds have vanes, which are rotatable about a vertical axis in order to open or close the blind. A current popular feature is to integrally form the vanes with a cover that extends across the vanes so as to diffuse incoming light and to provide an aesthetically pleasing appearance. One popular vane cover design is the u-shaped or scalloped design in which the cover forms folds between the vanes that extend in outward direction towards the viewer. Such covers typically include vanes made of a stiff fabric that are integrally attached together with strips of sheer fabric. One problem with such covers is that the material used to form the cover is expensive, and the manufacturing cost for the covers is likewise expensive. Furthermore, the stiffening and sheer fabrics are not washable in conventional washing machines. If washed in a conventional washing machine, the fabrics in the cover would be destroyed by the washing process. The washing process bends the stiffening fabric such that the stiffening vanes are no longer straight after washing. Another problem faced with the integral cover design is that the stiffening fabric does not have enough weight in order to counter balance the weight of the u-shaped folds. This creates an undesirable "swooped back-"look in which the cover angles back towards the window. Moreover, retrofitting an integral system to pre-existing vertical blind systems can be quite expensive.

SUMMARY OF THE INVENTION

One form of the present invention concerns a unique vertical blind cover system and method of manufacturing such a system.

A system according to a further form of the present invention includes a first blind vane having an edge portion and a second blind vane having an edge portion. The system includes a cover that forms a u-shaped fold that extends between the first vane and the second vane. A first reattachable fastener detachably couples the cover to the first vane at the edge portion of the first vane. The first fastener is constructed and arranged to allow the cover to be detached and reattached to the first vane. A second reattachable fastener detachably couples the cover to the second vane at the edge portion of the second vane. The second fastener is constructed and arranged to allow the cover to be detached and reattached to the second vane.

Related objects and advantages of the present invention will be apparent from the drawings and the following description.

DESCRIPTION OF SELECTED EMBODIMENTS

Figure 1:
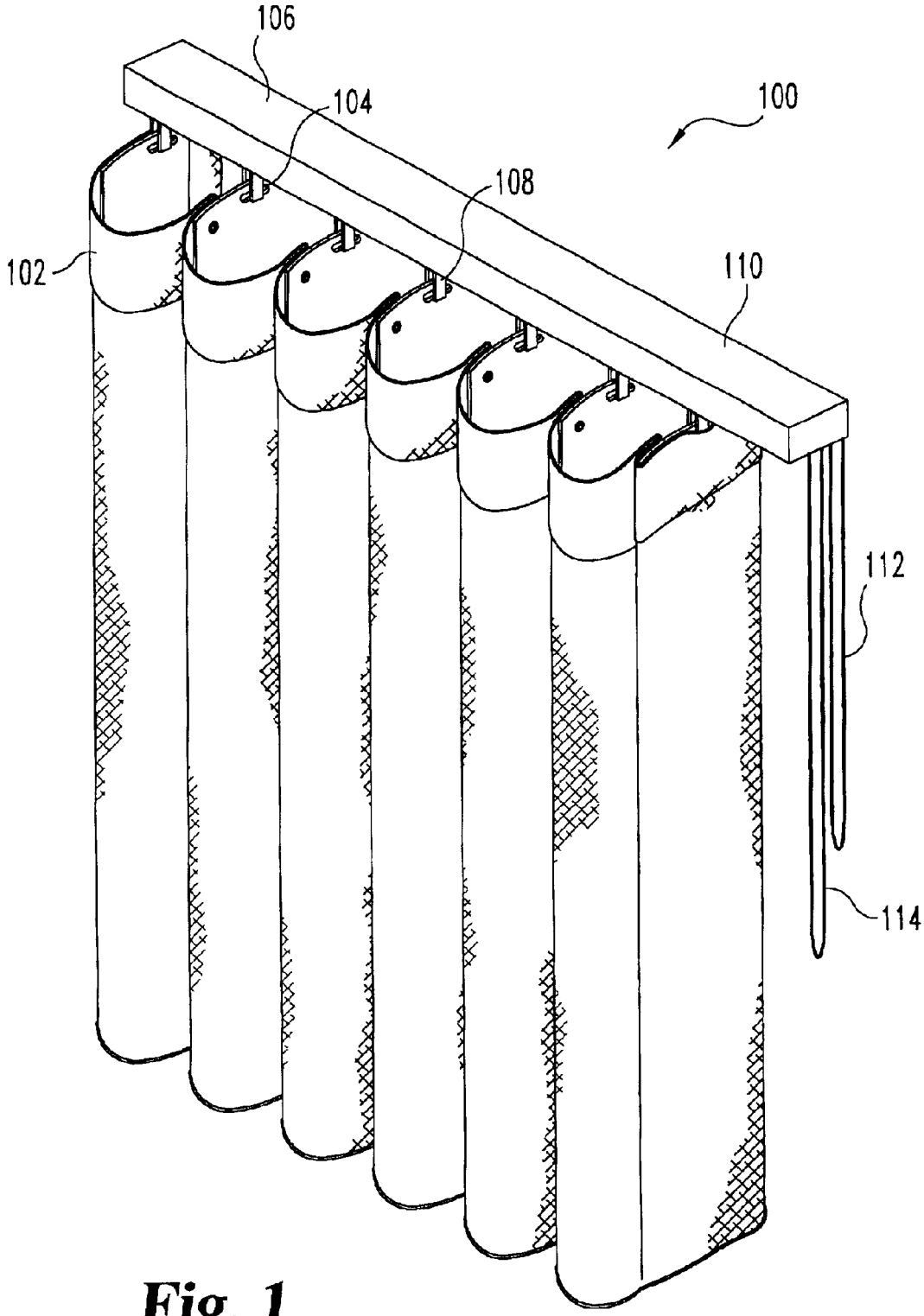
FIG. 1 is a perspective view of a vertical blind system with a vane cover according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 illustrates a vertical blind cover system 100 according to one embodiment, of many, of the present invention. As illustrated, system 100 includes a detachable vane cover 102 detachably coupled to vanes 104 and a vane mechanism 106 that supports the vanes 104. The vane mechanism 106 includes moveable carrier shafts or clips 108 to which the vanes 104 are attached, and the clips 108 are slidably received in a rail or housing 110. A move pulley 112 in the vane mechanism 106 is operatively coupled to the carrier clips 108 in order to move the vanes 104 laterally along the housing 110. A rotate pulley 114 is operatively coupled to the carrier clips 108 in order to rotate the vanes 104 into open or closed positions. As should be appreciated other type of mechanisms, such as rotatable rods and the like, can be used instead of pulleys 112 and 114 in order to operate the vane mechanism 106. The vanes 104 can be made of rigid or semi-rigid material such as plastic or metal. In one embodiment, the vanes 104 are made of a semi-rigid plastic.

Figure 2:
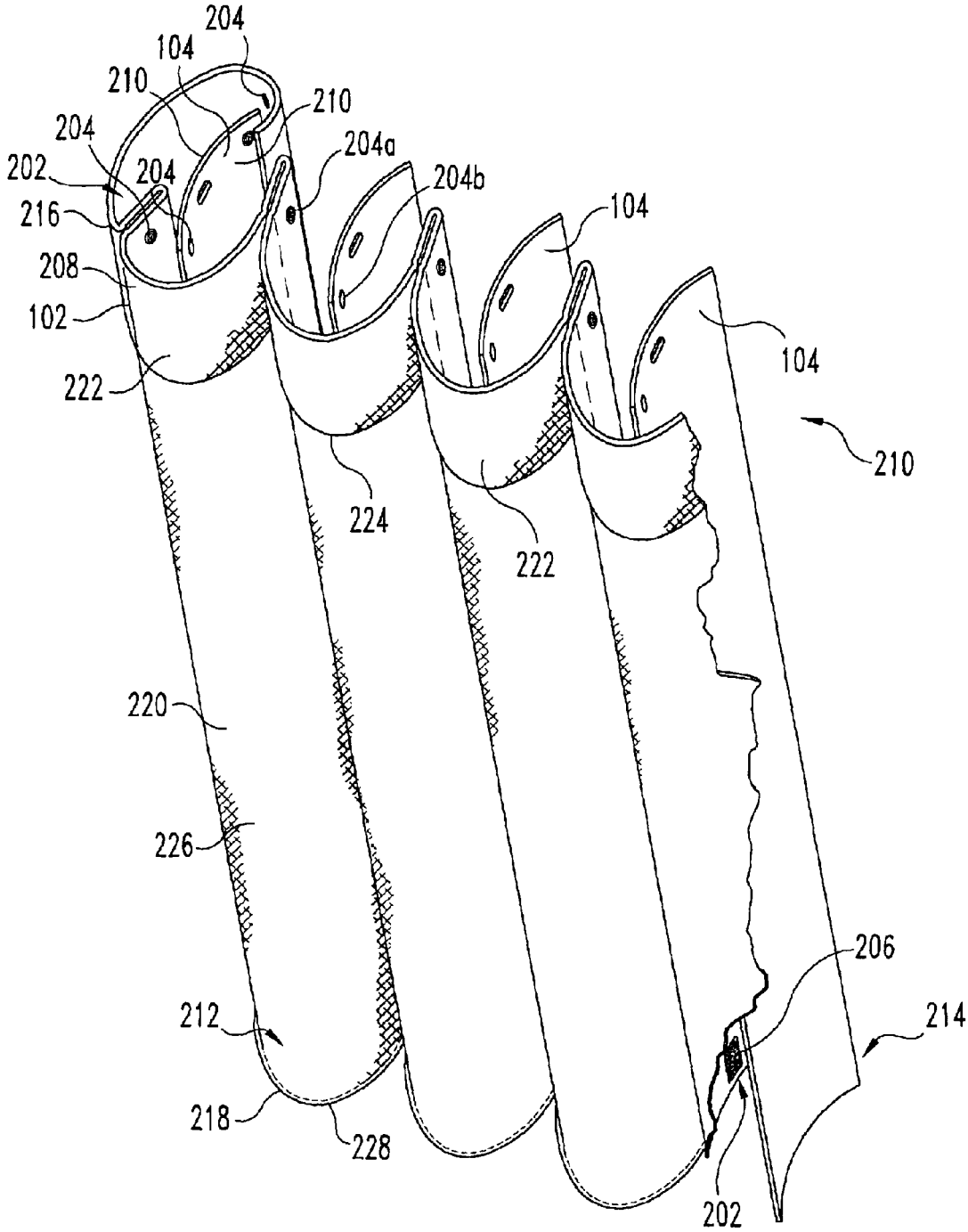
FIG. 2 shows an exploded view of the vane cover and vanes of the FIG. 1 system.

As illustrated in FIG. 2, the cover 102 is coupled to the vanes 104 with reattachable (detachable) fasteners 202. The reattachable fasteners 202 allow the cover 102 to be repeatedly removed and reattached to the vanes 104 without significantly marring and/or destroying the vanes 104. With reattachable fasteners 202, the cover 102 can be easily removed for cleaning or replaced with a different cover 102 in order to change a room's décor. The reattachable fasteners 202 can include snap type fasteners, VELCRO® brand type fastening strips (hereinafter "Velcro" ) and other types of reattachable fasteners, to name a few. It should be appreciated that while "Velcro" is a brand name, the term "Velcro" as used herein is not intended to limit the present invention to a specific brand or manufacturer of reattachable plastic hook and loop filament strips, but rather, is being used to connote the common generic usage of the term. In the illustrated embodiment, the fasteners 202 include snap fasteners 204 and Velcro strips 206 that are used to detachably secure the cover 102 to the vanes 104. As depicted, upper portion 208 of the cover 102 is secured to upper portion 210 of the vanes 104 with mating snap fasteners 204, and lower portion 212 of the cover 102 is secured to lower portion 214 of the vanes 104 with mating Velcro strips 206. Such a construction assures that upper edge 216 of the cover 102 appears straight to a viewer; while at the same time allowing greater flexibility in positioning the lower portion 212 of the cover 102 where straightness of lower edge 218 of the cover 102 is not as critical. Further, the Velcro strips 202 along with the rigidity of the vanes 104 allow the cover 102 to be placed in tension in order to reduce any wrinkling in the cover 102. It was discovered that the cover 102 only needed to be secured at the upper 210 and lower 214 portions of the vanes 104 in order to provide a wrinkle free appearance. However, it should be understood that additional fasteners 202 can be added along the cover 102 and the vanes 104. In one embodiment, the Velcro strips 206 are separately glued to both the cover 102 and the vanes 104, and in another embodiment, the Velcro strips 206 are sewn onto the cover 102. In one embodiment, the cover 102 has male snaps 204*a* and the vanes 104 have corresponding female snaps 204*b*. As should be appreciated, the cover 102 can have female snaps 204*b* or a combination of male and female snaps 204. Furthermore, it should be appreciated that all or portions of the fasteners 202 can be integrally formed in the cover 102 and the vanes 104.

The cover 102 is made of a washable fabric so that the cover 102 can be removed from vanes 104 and washed in a conventional (water based) washing machine without being ruined. For example, this washable fabric can include, but is not limited to, natural fabrics such as cotton and artificial fabrics such as nylon and polyester, to name a few. In the embodiment illustrated in FIG. 2, the cover 104 includes a sheer type fabric portion 220 that is made of a sheer type washable fabric and a generally opaque stiffening (backing) fabric strip 222 that is sewn inside the sheer fabric at the upper portion 208 of the cover 102 (see FIG. 7). As should be appreciated, the stiffening strip 222 can be attached to the sheer type fabric in other manners, such as by gluing strip 222 to the sheer fabric. The sheer fabric portion 220 diffuses the light that shines through the vanes 104 when the vanes 104 are in an opened position. The sheer fabric is folded over the stiffening fabric strip 222 and sewn at a bottom edge portion 224 of the stiffening strip 222. Due to the opaque (or semi-opaque) nature of strip 222, the stiffening strip 222 hides the clips 108 and the snaps 204 from view. Moreover, the stiffening strip 222 helps form and maintain the outward facing, u-shaped or scalloped folds 226 in the cover 102. At the lower portion 212 of the cover 102, the cover has a hemmed portion 228.

Figure 3:
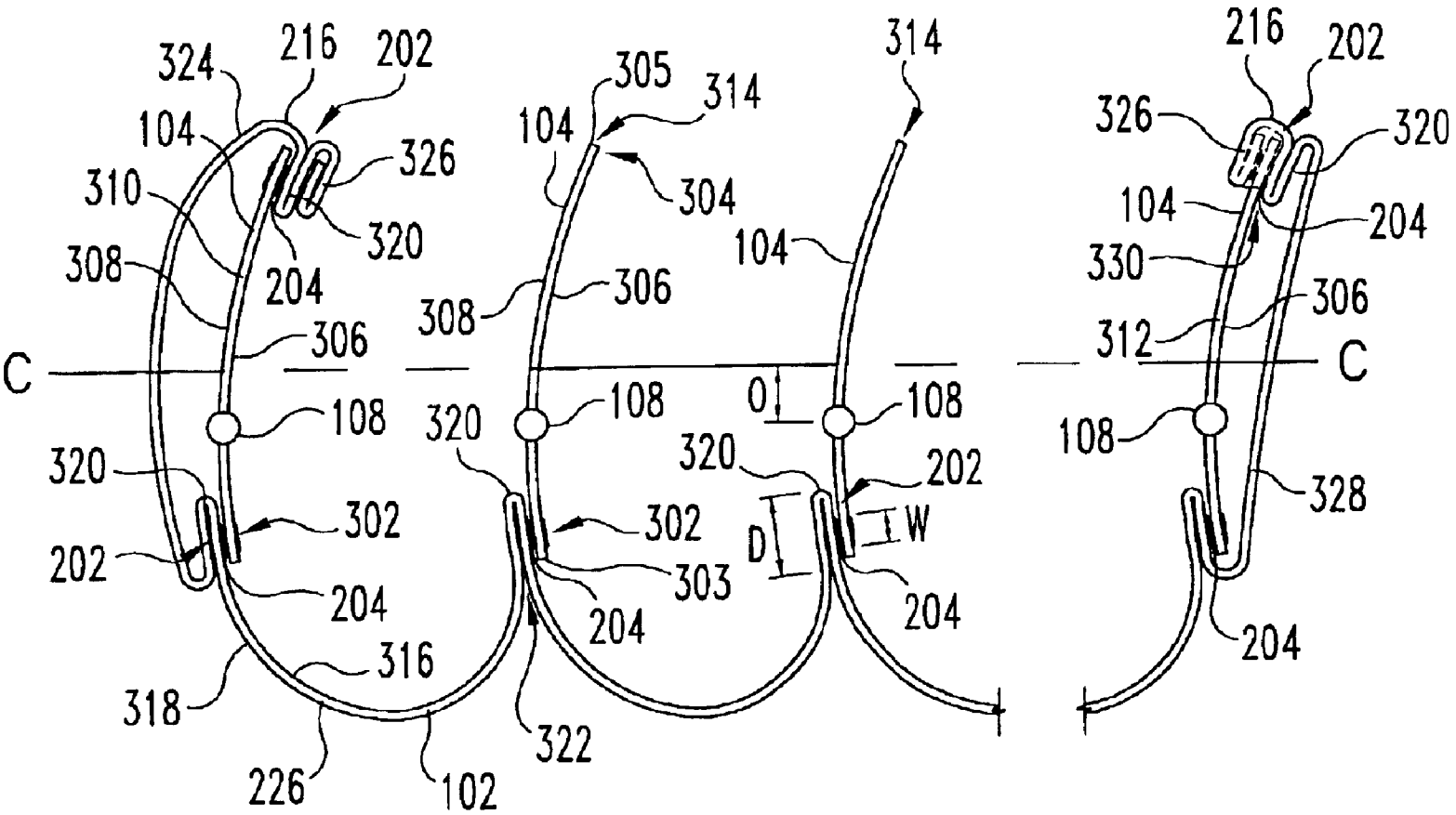
FIG. 3 shows a top, cross sectional view of the vane cover attached to the vanes in the FIG. 1 system.
Figures 4A, 4B, 5A, 5B, 6A, 6B:
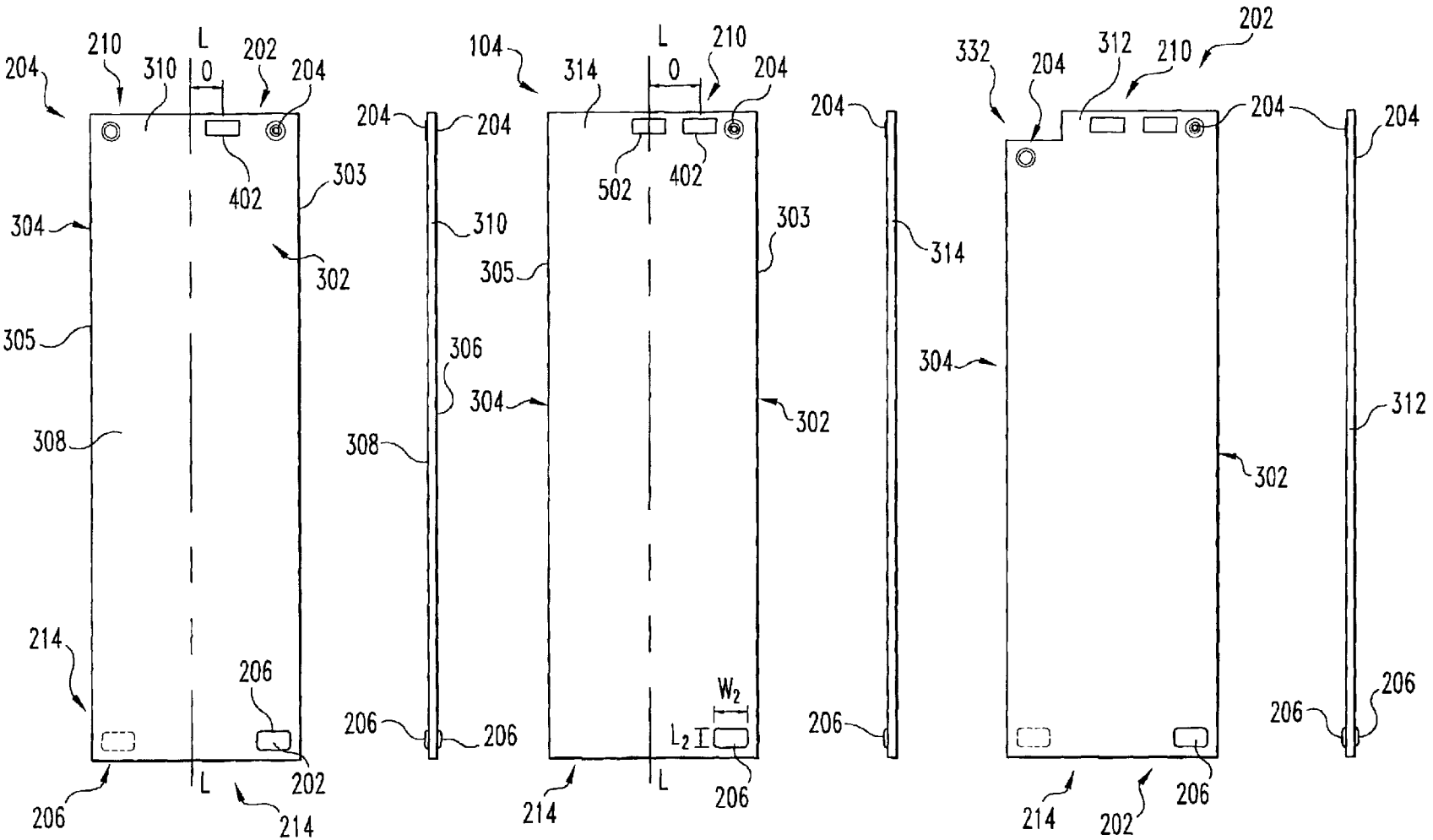
FIG. 4A shows a side view of a first end vane in the FIG. 1 system.
FIG. 4B shows a front view of the first end vane.
FIG. 5A shows a side view of a middle vane in the FIG. 1 system.
FIG. 5B shows a front view of the middle vane.
FIG. 6A shows a side view of a second end vane in the FIG. 1 system.
FIG. 6B shows a front view of the second end vane.
Figure 7:
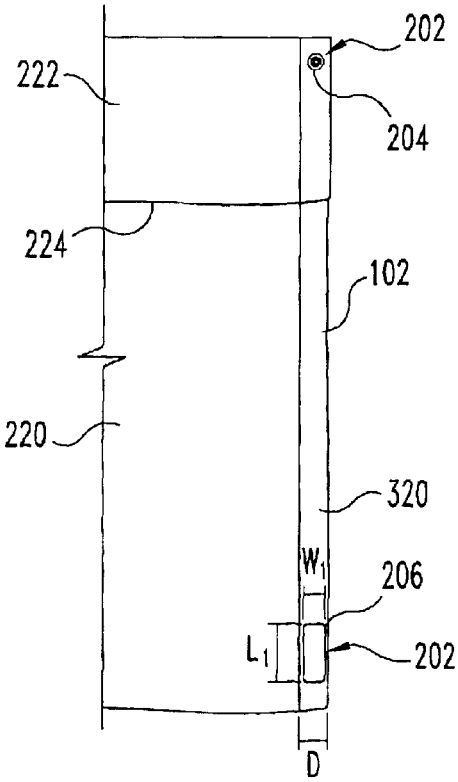
FIG. 7 shows a partial side view of the vane cover.

As shown in greater detail in FIGS. 3–6, the vanes 104 include an inboard (inside) edge portion 302 located proximal along inboard edge 303 and an opposite outboard (outside) edge portion 304 located proximal along outboard edge 305. When the vanes are in an opened position, the inboard edge 303 generally faces the viewer (room occupant), and the outboard edge 305 generally faces an opening, such as a window. The vertical blind cover system 100 according to the present invention allows the cover 102 to be easily retrofitted to and/or attached/removed from vanes 104 that have a bowed shaped. In the illustrated embodiment, the vanes 104 have a bowed shape. Between the edge portions 302 and 304, the vanes have a first surface 306 that has a concave shape and a second surface 308 that has a convex shape. The vanes 104 include a first end vane 310, a second end vane 312, and one or more middle vanes 314 located between the first 310 and second 312 end vanes. In the illustrated embodiment, the vane cover 102 is formed from a continuous sheet of fabric, which reduces the manufacturing cost of the cover 102. As mentioned above, in one embodiment, the cover 102 is made of a sheer type fabric that is folded over and attached to the stiffening strip 222 at the upper portion 208 of the cover 102. In FIG. 3, the cover 102 includes outboard-facing (outside) surface 316 and an opposite, inboard-facing (inside) surface 318. For each vane 104, the outboard-facing surface 316 of the cover 102 has at least one closed pleat 320 at which one or more fasteners 202 are attached. As shown, pleat 320 is closed at connection portion 322 and extends the entire length of the cover 102 from upper portion 208 to lower portion 210. In one form, the fabric is sewn together at the connection portion 322, and in another form, the fabric at portion 322 is glued together. It should be understood that the fabric can be joined together in other generally known manners in order to form the closed pleat 320. To conserve fabric, the closed pleat 320 in one form does not extend the full width of the vane 104; rather, the closed pleat 320 has a depth D that is equal to or slightly greater than width W of the fastener 202. In one embodiment, as shown in FIG. 7, the Velcro strip 206 has a width W1 that is approximately equal to the depth D of the closed pleat 320. In order to allow the position of the lower portion 212 of the cover 102 to be adjusted in multiple directions while at the same time reducing the amount of Velcro strips 206 used, the Velcro strip 206 on the vanes 104 (FIG. 5A) has a length L2 that is less than length L1 of the Velcro strip 206 on the cover 102 and a width W2 that is greater than width W1 of the Velcro strip 206 on the cover 102. When mated together the perpendicularly oriented Velcro strips 206 on the cover 102 and the vane 104 form a cross pattern such that the lower portion 212 of the cover 102 can be both vertically and horizontally repositioned.

At the first end vane 310, the cover 102 has a first end portion 324 that covers the convex surface (side) 308 of the first end vane 310. As shown in FIGS. 3 and 4A–B, the cover 102 at portion 324 wraps around the outboard end 305 of the vane 104 and is attached by fasteners 202 to the concave surface 306 at the outboard end portion 304. In the illustrated embodiment, the fasteners 202 on the concave surface 306 of the first end vane 310 are snap fastener 204 at the upper portion 210 and Velcro strip 206 at the lower portion 214. Both the snap fastener 204 and the Velcro strip 206 are secured to pleat 320 and finishing pleat 326 is attached at the upper edge 216 to pleat 320 in order to hide the backside of the snap fastener 204 so as to provide a finished appearance.

As shown in FIGS. 3–6, the convex surface 308 of each vane 104 has fasteners 202 at their respective inboard edge portions 302. In the particular illustrated embodiment, the convex surface 308 has snap fastener 204 at the upper portion 210 and Velcro strip 206 at the lower portion 214. It should be understood that fasteners 202 on the vanes 104 can be flush with the edges of the vanes 104 and/or can be slightly offset from the edges of the vanes 104. It was discovered that placing the fasteners 202 on the convex surface 308, as opposed to the concave surface 306, of the inboard edge portion 302 of the vanes 104 made removal and reattachment of the cover 102 easier. One of many factors that made the convex surface 308 a more desirable location was that the convex surface 308 provided greater visibility for the fastener 202 as compared to the concave surface 306 so that an installer does not have to "blindly" attach the fasteners 202.

At the second end vane 312, the cover 102 has a second end portion 328 that covers the concave surface 306 of the second end vane 312. As shown in FIG. 3, the cover 102 at the second end portion 328 has pleat 320 to which fastener 202 is attached and finishing pleat 326. The finishing pleat 326 is attached at the upper edge 216 to the closed pleat 320 so as to form a pocket 330 in which the outboard end portion 304 of the second end vane 312 is received. As shown, the fastener 202 on the closed pleat 320 faces the finishing pleat 326 and engages the fastener 202 on the concave side 306 of the second end vane 312. As should be appreciated two pleats 320 can be used to secure the cover 102 at the inboard edge portion 302 of the vane 104. In one form of the present invention, the cover 102 can have closed pleat 320 and finishing pleat 326 with each having a fastener 202 in order to secure the cover 102 to the inboard edge portion 302 of the same vane 106 on opposite sides 306 and 308 of the vane 106. In the embodiment illustrated in FIGS. 6A and 6B, the outboard edge 304 of the second end vane 312 has a snap fastener 204 at the upper edge portion 210 and a Velcro strip 206 at the lower edge portion 214. As illustrated in FIG. 6, the outboard edge portion 304 of the second end vane 312 has a notch 332 formed at the upper edge portion 210. The pocket 330 of the cover 102 is received over the notch 332, and the notch 332 ensures that the upper edge 216 of the cover 102 is level. As should be appreciated, the pocket 330 and notch 332 construction can be used to secure the cover 102 to the inboard edge portion 302 of the vane 104. In another form, the first end vane 310 has notch 332 defined therein such that the first 310 and second 312 end vanes are the same in order to reduce the number of components.

As depicted in FIGS. 3–5, the carrier clips 108 are attached the to the vanes 104 at an offset distance O from a center plane C formed by longitudinal centerlines L of the vanes 104. As shown, the carrier clips 108 are offset towards the inboard edge portion 302 of the vanes 104 in order to counter-balance the cover 102 when attached to the vanes 104. Referring to FIG. 4A, an offset clip opening 402 to which the clips 108 are attached is offset distance O from the centerline L of the vane 104 toward the inboard edge portion 302 in order to reduce the amount of back swooping in the cover 102 when attached to the vanes 104. As shown in FIG. 4A, the vane 104 can be prefabricated with a single offset clip opening 402. Alternatively, as shown in FIG. 5A, the offset clip opening 402 can be formed in a vane that has a preexisting centered clip opening 502.

Figure 8:
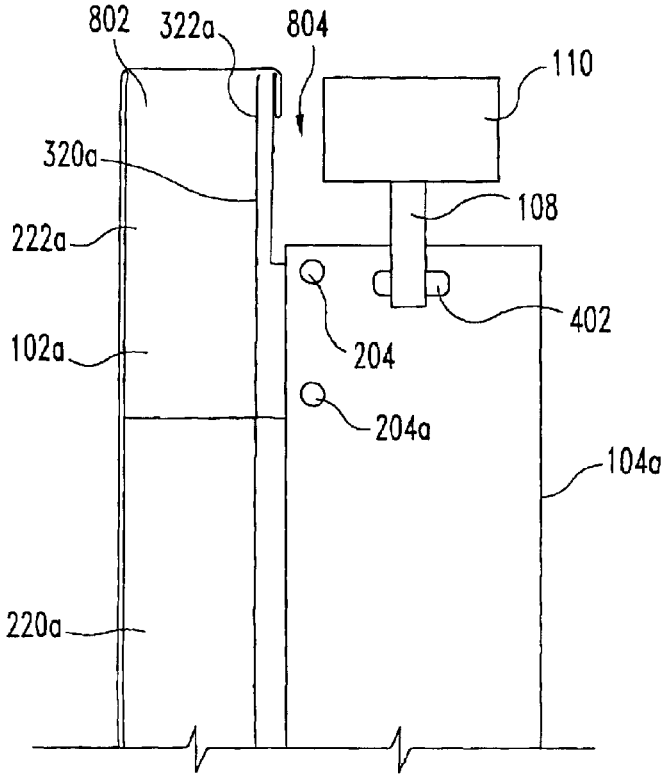
FIG. 8 shows a partial cross sectional side view of a vertical blind system according to another embodiment of the present invention.

A cover 102*a* according to another embodiment of the present invention is illustrated in FIG. 8. In the illustrated embodiment, cover 102*a* has an extension portion 802 that hides housing 110 from view, and the extension portion 802 includes a stiffening strip 222*a*. To minimize puckering of the stiffening strip 222*a*, cover 102*a* and vane 104*a* have a second snap fastener 204*a* located below snap fastener 204 along the stiffening strip 222*a*. In one form, snap fastener 204*a* is located approximately two-inches (2") below snap fastener 204 along the inboard edge portion 302 of the vane 104*a*. Below stiffening strip 222*a*, the cover 102*a* has a sheer fabric portion 220*a*. In extension portion 802, a housing notch 804 is formed in closed pleat 320*a* in order to accommodate the housing 110. As depicted in FIG. 8, connection portion 322*a* closes the closed pleat 320*a* at housing notch 804.

Another feature of the present invention is that the reattachable cover 102 can be easily and inexpensively retrofitted to conventional vertical blind systems. Initially, vane 104, as shown in FIG. 5A, has central clip opening 502 at which the vane 104 is originally suspended from the carrier clips 108. The vanes 104 are removed from the carrier clips 108, and the offset clip openings 402 are formed offset distance 0 from the centered clip openings 502. In one form, the offset clip opening 402 is formed by punching opening 402 into the vane 104. As should be appreciated, additional offset clip openings 402 can be formed so that the vane 104 can support covers 102 of differing weight and size. Notch 332 is also formed in the second end vane 312. The fasteners 202 are attached to the vanes 104 at the locations described above. In one form, the fasteners 202 are glued to the vanes. Alternatively or additionally, the snap fasteners 204 can be attached by pressingly engaging the vane 104 between an o-ring and body of the snap fastener 204. After the fasteners 202 are secured to the vanes 104, the vanes 104 can be re-hung on the carrier clips 108 by the offset clip openings 402.

In one embodiment, the cover 102 is created by folding sheer type fabric over the stiffening strip 222 and securing the fabric to the stiffening strip in the manner as described above. In one form, the sheer fabric is sewn to the stiffening strip 222. Pleats 320 and 324 are formed on the cover and fasteners 202 are attached the closed pleats 320 at positions corresponding to their respective mating fasteners 202 on the vanes 104. Next, the fasteners 202 of the cover 102 are attached to the fasteners 202 on the vanes 104 such that the u-shaped folds 226 are formed. At a later time, the cover 102 can be removed for cleaning or replaced with a differently styled cover 102. While the cover 102 is being cleaned, the vanes 104 can be hung on the carries 108 by their original central clip openings 502. This ensures that the vanes 104 are balanced and operate properly when the cover 102 is not attached. Before the cover 102 is reattached, the vanes 104 can again be hung by the offset clip openings 402.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus, comprising:

a first blind vane having an edge portion;

a second blind vane having an edge portion;

a cover forming a u-shaped fold that extends between said first vane and said second vane; and a first reattachable fastener detachably coupling said cover to said first vane at said edge portion of said first vane, said first fastener being constructed and arranged to allow said cover to be detached and reattached to said first vane;

a second reattachable fastener detachably coupling said cover to said second vane at said edge portion of said second vane, said second fastener being constructed and arranged to allow said cover to be detached and reattached to said second vane;

wherein said vane has a central longitudinal axis;

wherein said first vane defines an offset clip opening from which said first vane is hung; and wherein said offset clip opening is offset with respect to said central longitudinal axis toward said edge portion of said first vane.

2. The apparatus of claim 1, wherein said first vane includes a vertical blind vane.

3. The apparatus of claim 1, wherein said edge portion includes an inboard edge portion.

4. The apparatus of claim 1, wherein said cover is a continuous sheet of fabric.

5. The apparatus of claim 4, wherein said cover includes a stiffening strip and a sheer type fabric portion hanging from said stiffening strip.

6. The apparatus of claim 1, further comprising:

wherein said edge portion of said first vane includes an inboard edge portion;

wherein said first vane has an outboard edge portion opposite said inboard edge portion;

wherein said first vane has a first surface and an opposite second surface between said inboard edge portion and said outboard edge portion; and a third reattachable fastener detachably coupling said cover to said first surface of said first vane at said outboard edge portion.

7. The apparatus of claim 6, wherein said cover extends from said first fastener to said third fastener and covers said first surface.

8. The apparatus of claim 6, wherein said cover extends from said first fastener to said third fastener and covers said second surface.

9. The apparatus of claim 6, wherein:

said first surface has a concave shape; and said second surface has a convex shape.

10. The apparatus of claim 6, wherein:

said first vane defines a notch at said outboard end; and said cover defines a pocket that is received over said notch.

11. The apparatus of claim 1, further comprising:

wherein said first vane has an upper portion and a lower portion;

wherein said first fastener is positioned at said upper portion of said first vane; and a third reattachable fastener detachably coupling said cover to said first vane at said edge portion of said first vane, said third fastener being positioned at said lower portion of said first vane.

12. The apparatus of claim 11, wherein:

said first fastener includes a snap fastener; and said third fastener includes a Velcro fastener.

13. The apparatus of claim 12, wherein said Velcro fastener includes a first Velcro strip attached to said cover and a second Velcro strip attached to said vane, said first Velcro strip being attached to said second Velcro strip in a cross-wise fashion.

14. The apparatus of claim 1, wherein said first fastener includes a snap fastener.

15. The apparatus of claim 1, wherein:

said cover includes a first closed pleat and a second closed pleat;

said first fastener is attached to said cover at said first closed pleat; and said second fastener is attached to said cover at said second closed pleat.

16. The apparatus of claim 1, further comprising:

a vane mechanism from which said first vane and said second vane are hung; and wherein said cover includes an extension portion to cover said vane mechanism.

17. An apparatus, comprising:

a first blind vane having an edge portion;

a second blind vane having an edge portion;

a cover forming a u-shaped fold that attends between said first vane and said second vane;

a first reattachable fastener detachably coupling said cover to said first vane at said edge portion said first vane, said first fastener being constructed and arranged to allow said cover to be detached and retched to said first vane;

a second reattachable fastener detachably coupling said cover to said second vane at said edge portion of said second vane, said second fastener being constructed and arranged to allow said cover to be detached and reattached to said second vane;

wherein said cover includes a first closed pleat and a second closed pleat;

wherein said first fastener is attached to said cover at said first closed pleat; and wherein said second fastener is attached to said cover at said second closed pleat.

18. The appartus of claim 17, wherein said first vane includes a vertical blind vane.

19. The apparatus of claim 17, wherein said cover is a continuous sheet of fabric.

20. The apparatus of claim 17, further comprising:

wherein said edge portion of said first vane includes an inboard edge portion;

wherein said first vane has an outboard edge portion opposite said inboard edge portion;

wherein said first vane has a first surface and an opposite second surface between said inboard edge portion and said outboard edge portion; and a third reattachable fastener detachably coupling said cover to said first surface of said first vane at said outboard edge portion.

21. The apparatus of claim 20, wherein:

said first vane defines a notch at said outboard end; and said cover defines a pocket that is received over said notch.

22. The apparatus of claim 17, further comprising:

wherein said first vane has an upper portion and a lower portion;

wherein said first fastener is positioned at said upper portion of said first vane; and a third reattachable fastener detachably coupling said cover to said first vane at said edge portion of said first vane, said third fastener being positioned at said lower portion of said first vane.

23. The apparatus of claim 22, wherein:

said first fastener includes a snap fastener, and said third fastener includes a Velcro fastener.

24. The apparatus of claim 23, wherein said Velcro fastener includes a first Velcro strip attached to said cover and a second Velcro strip attached to said vane, said first Velcro strip being attached to said second Velcro strip in a cross-wise fashion.

25. The apparatus of claim 17, wherein said first fastener includes a snap fastener.

26. The apparatus of claim 17, further comprising:

a vane mechanism from which said first vane and said second vane are hung; and wherein said cover includes an extension portion to cover said vane mechanism.

27. An apparatus, comprising:

a first blind vane having an edge portion;

a second blind vane having an edge portion;

a cover forming a u-shaped fold that extends between said first vane and said second vane;

a first reattachable fastener detachably coupling said cover to said first vane at said edge portion of said first vane, said first fastener being constructed and arranged to allow said cover to be detached and reattached to said first vane;

a second reattachable fastener detachably coupling said cover to said second vane at said edge portion of said second vane, said second fastener being constructed and arranged to allow said cover to be detached and reattached to said second vane;

wherein said edge portion of said first vane includes an inboard edge portion;

wherein said first vane has an outboard edge portion opposite said inboard edge potion;

wherein said first vane has a first surface and an opposite second surface between said inboard edge portion and said outboard edge portion;

a third rettachable fastener detachably coupling said cover to said first surface of said first vane at said outboard edge portion;

wherein said first vane defines a notch at said outboard end; and wherein said cover defines a pocket that is received over said notch.

28. The apparatus of claim 27, wherein said cover is a continuous sheet of fabric.

29. The apparatus of claim 27, wherein said first fastener includes a snap fastener.

30. An apparatus, comprising:

a vertical blind vane mechanism;

a first vertical blind vane suspended from said vane mechanism, said first vane having an inboard edge portion and an opposite outboard edge portion, said first vane having a convex surface and an opposite concave surface disposed between said inboard edge portion and said outboard edge portion of said first vane;

a second vertical blind vane suspended from said vane mechanism, said second vane having an inboard edge portion and an opposite outboard edge portion, said second vane having a convex surface and an opposite concave surface disposed between said inboard edge portion and said outboard edge portion of said second vane;

a washable cover extending between said first vane and said second vane, said cover having a first pleat proximal said first vane and a second pleat proximal said second vane, said cover having an upper portion and a lower portion;

a first upper reattachable fastener reattachably coupling said first pleat at said upper portion to said convex surface of said first vane at said inboard edge portion of said first vane;

a first lower reattachable fastener coupling said first pleat at said lower portion to said convex surface of said first vane at said inboard edge portion of said first vane;

a second upper reattachable fastener reattachably coupling said second pleat at said uppper portion to said convex surface of said second vane at said inboard edge portion of said second vane;

a second lower reattachably fastner reattachable coupling said second pleat at said lower portion to said convex surface of said second vane at said inboard edge portion of said second vane;

a third upper reattachable fastener reattachably coupling said first pleat at said upper portion to said convex surface of said first vane at said inboard edge portion of said fist vane, said third upper reattachable fastner being positioned below said first upper upper reattachable fastener to minimize puckering of said cover; and wherein said cover includes an extension portion to cover said housing.

31. The apparatus of claim 30, wherein:

said first upper fastener and said second upper fastener include snap fasteners; and said first lower fastener and said second lower fastener include Velcro strips.

32. The apparatus of claim 31, wherein said first pleat and said second pleat have widths approximately equal to widths of said Velcro strips.

33. The apparatus of claim 30, wherein:

said first vane a central longitudinal axis and an offset notch that is offset from said central axis; and said first vane is suspended from said vane mechanism at said offset notch.

34. An apparatus, comprising:

a vertical blind vane mechanism;

a first vertical blind vane suspended from said vane mechanism said first vane having an inboard edge portion and an opposite outbord edge portion, said first vane having a convex surface and an opposite concave surface disposed between said inboard edge portion and said outboard edge portion of said first vane;

a second vertical blind vane suspended from said vane mechanism, said second vane having an inboard edge portion and an opposite outboard edge portion, said second vane having a convex surface and an opposite concave surface disposed between said inboard edge portion and said outboard edge portion of said second vane;

a washable cover extending between said first vane and said second vane, said cover having a first pleat proximal said first vane and a second pleat proximal said second vane, said cover having an upper portion and a lower portion;

a first upper reattachable fastener reattachably coupling said first pleat at said upper portion to said convex surface of said first vane at said inboard edge portion of said first vane;

a first lower reattachable fastener reattachably coupling said first pleat at said lower portion to said convex surface of said first vane at said inboard edge portion of said first vane;

a second upper reattachable fastener reattachably coupling said second pleat at said upper portion to said convex surface of said second vane at said inboard edge portion of said second vane;

a second lower reattachable fastener reattachably coupling said second pleat at said lower portion to said convex surface of said second vane at said inboard edge portion of said second vane;

wherein said first vane a central longitudinal axis and an offset notch that is offset from said central axis; and wherein said first vane is suspended from said vane mechanism at said offset notch.

35. The apparatus of claim 34, wherein:

said first upper fastener and said second upper fastener include snap fasteners; and said first lower fastener and said second lower fastener include Velcro strips.

36. The apparatus of claim 35, wherein said first pleat and said second pleat have widths approximately equal to widths of said Velcro strips.

* * * * *